United States Patent [19]

Sano

[11] 4,344,345

[45] Aug. 17, 1982

[54] AUTOMATIC RHYTHM ACCOMPANIMENT SYSTEM

[75] Inventor: Shigenori Sano, Higashiyamato, Japan

[73] Assignee: Casio Computer Co., Ltd., Tokyo, Japan

[21] Appl. No.: 215,756

[22] Filed: Dec. 12, 1980

[30] Foreign Application Priority Data

Dec. 26, 1979 [JP] Japan ..... 54-169561

[51] Int. Cl.[3] ..... G10F 1/00

[52] U.S. Cl. ..... 84/1.03; 84/DIG. 12; 84/DIG. 22

[58] Field of Search ..... 84/1.03, DIG. 12, 1.24, 84/DIG. 22, 1.01

[56] References Cited

U.S. PATENT DOCUMENTS 3,889,568 6/1975 Amaya ..... 84/DIG. 12
4,089,245 5/1978 Dietrich ..... 84/1.03
4,129,055 12/1978 Whittington et al. ..... 84/DIG. 22
4,217,805 8/1980 Tamada ..... 84/DIG. 12
4,256,005 3/1981 Mishima ..... 84/DIG. 12

*Primary Examiner*—J. V. Truhe
*Assistant Examiner*—Forester W. Isen
*Attorney, Agent, or Firm*—Frishauf, Holtz, Goodman & Woodward

[57] ABSTRACT

An automatic rhythm accompaniment system comprises memory units storing a plurality of rhythm patterns and a designating switch for selecting a desired rhythm pattern. A memory unit is further contained in the system for previously storing chord progress data and further storing control data to fill in an ad-lib rhythm. Therefore, the rhythm accompaniment system may perform the ad-lib rhythm in place of the rhythm pattern by the switch designation for each measure. Additionally, the accompaniment based on the chord progress data may also be performed automatically.

6 Claims, 16 Drawing Figures

| | KO1 | KO2 | KO3 | KO4 | KO5 | KO6 | KO7 | KO8 |
|---|---|---|---|---|---|---|---|---|
| KI0 | VARIATION CONTROL SWITCH 1 (VCS 1) | VCS 2 | VCS4 | VCS 8 | VCS16 | VCS32 | VCS64 | |
| KI1 | PROGRAMMABLE RHYTHM SELECT SWITCH 1 (PRSS 1) | PRSS 2 | PRSS 3 | PRSS 4 | PRSS 5 | PRSS 6 | PRSS 7 | PRSS 8 |
| KI2 | RHYTHMIC SOUND SELECT SWITCH a (RTSS a) | RTSSb | RTSS c | RTSS d | RTSS e | RTSS f | RTSS g | RTSS h |
| KI3 | CHANNEL SELECT SWITCH 1 (CSS 1) | CSS 2 | CSS 3 | CSS 4 | | | | |
| KI4 | PRESET RHYTHM SELECT SWITCH A (PRSS A) | PRSS B | PRSS C | PRSS D | PRSS E | PRSS F | PRSS G | PRSS H |

FIG. 5

| (PS) | (CS) | MUSICAL INSTRUMENT NAME | RHYTHM PATTERN |
|---|---|---|---|
| 1 | 1 | | |
| | 2 | | |
| | 3 | | |
| | 4 | | |
| 2 | 1 | | |
| | 2 | | |
| | 3 | | |
| | 4 | | |
| | | | |
| | | | |
| 8 | 1 | | |
| | 2 | | |
| | 3 | | |
| | 4 | | |

FIG. 6

| | | |
|---|---|---|
| 1 ST. MEASURE | AFLAG | AD-LIB RHYTHM NO. |
| | CHORD | |
| 2ND. MEASURE | AFLAG | AD-LIB RHYTHM NO. |
| | CHORD | |
| | | |

FIG. 7

| | | VC |
|---|---|---|
| VARIATION CONTROL SWITCH | 1 | 0 0 0 0 0 0 1 |
| | 2 | 0 0 0 0 0 1 0 |
| | 4 | 0 0 0 0 1 0 0 |
| | 8 | 0 0 0 1 0 0 0 |
| | 16 | 0 0 1 0 0 0 0 |
| | 32 | 0 1 0 0 0 0 0 |
| | 64 | 1 0 0 0 0 0 0 |

FIG. 10A CNT 0 0 0 0 0 0 0 0

FIG. 10B CNT 0 0 0 0 0 0 0 1

FIG. 10C CNT 0 0 0 0 0 0 1 0

FIG. 10D CNT 0 0 0 0 0 1 0 1

FIG. 10E CNT 1 0 1 0 1 0 1 0

AUTOMATIC RHYTHM ACCOMPANIMENT SYSTEM

BACKGROUND OF THE INVENTION

The present invention relates to an automatic rhythm accompaniment system to fill in an ad-lib rhythm.

In a conventional rhythm accompaniment system, a rhythm is monotonously repeated in accordance with a single rhythm pattern selected. For this reason, a music performed by using the rhythm accompaniment system was monotonous and poor striking. To solve this problem, in a rhythm box or a rhythm machine, there is developed an apparatus to automatically produce a rhythm sound based on an ad-lib rhythm pattern called a fill-in, in place of a constant rhythm pattern, every four or eight measures. The apparatus, however, produces a mere repeat of the rhythm sounds in accordance with the ad-lib rhythm pattern every four or eight measures. The monotonous problem is still involved in the apparatus.

Accordingly, an object of the present invention is to provide an automatic rhythm accompaniment system which stores control data to make the ad-lib rhythm performance for given time intervals and the chord progress data, and thereby enables the ad-lib performance to be made at proper locations in a musical piece.

SUMMARY OF THE INVENTION

To achieve the above object, there is provided an automatic rhythm accompaniment system comprising: a first memory means for storing a plurality of rhythm pattern data; a selecting means for selecting one of the rhythm pattern data; a second memory means for storing chord progress data and control data for reading out from the first memory means other rhythm pattern data than the rhythm pattern data designated by the selecting means in accordance with the chord progress data; a rhythm sound generating means coupled with the first memory means for generating rhythm sounds in accordance with the rhythm pattern obtained from the first memory means; and an accompaniment sound generating means coupled with the second memory means for generating accompaniment sounds according to the chord progress data.

With such an arrangement, the automatic rhythm accompaniment system of the present invention stores control data to effect the control for making the ad-lib rhythm fill-in for given periods and chord progress data as well and automatically makes an ad-lib rhythm fill-in different from the normal rhythm fill-in at proper locations in a musical piece. Therefore, the rhythm sound outputted may be changed based on a desired rhythm pattern for properly set measures. This feature can automatically make varied rhythm accompaniment. Therefore, even a beginner can easily perform a complex musical piece when he makes a melody performance in harmony with varied rhythm accompaniment.

The present invention will be better understood from the following description taken in conjunction with the accompanying drawings.

BRIEF DESCRIPTION OF THE DRAWINGS

FIG. 5 is a construction of data area in a RAM 30;

FIG. 6 is a construction of a data area in a RAM 31;

FIG. 7 is a relation of switching positions of a variation control switch 22 to the contents set in a VC register;

FIGS. 10A to 10E show a change of memory states in a CNT register in the rhythm write mode.

DETAILED DESCRIPTION

Figure 1:
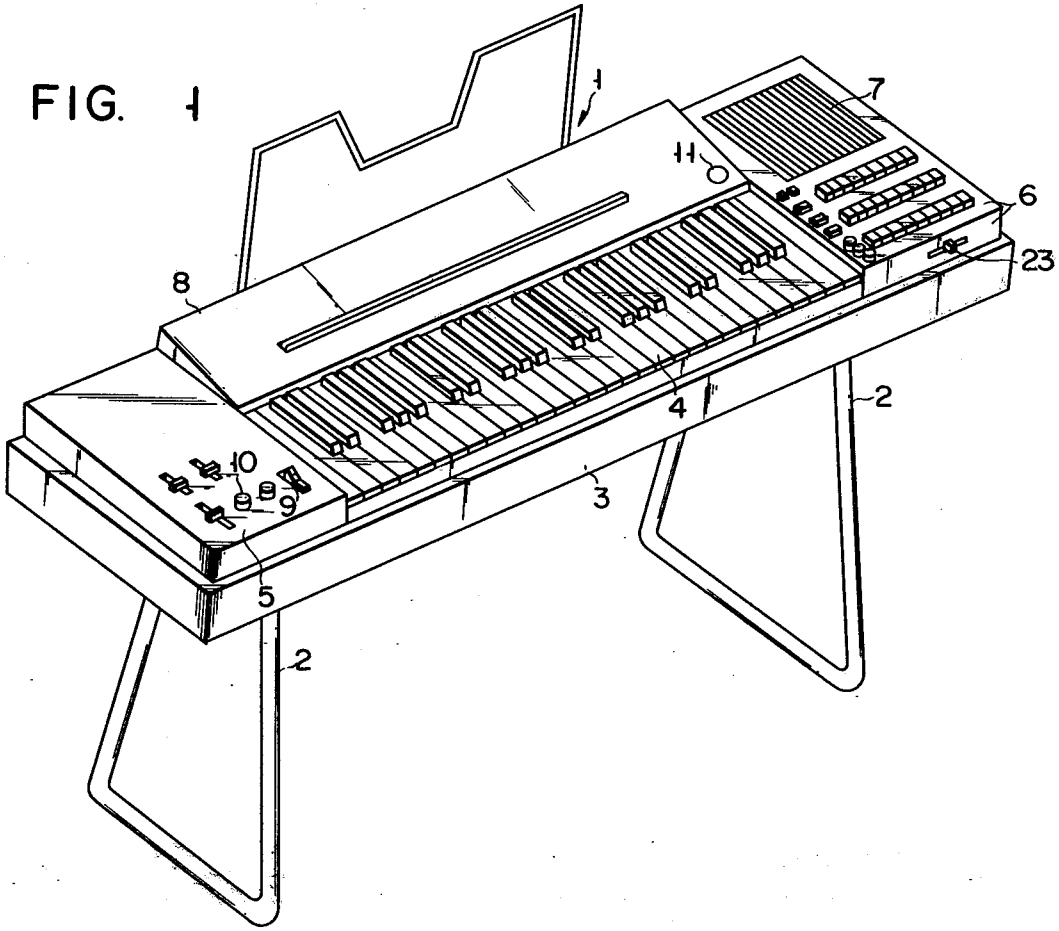
FIG. 1 shows an external perspective view of an embodiment when the present invention is incorporated into an electronic organ.
Figure 2:
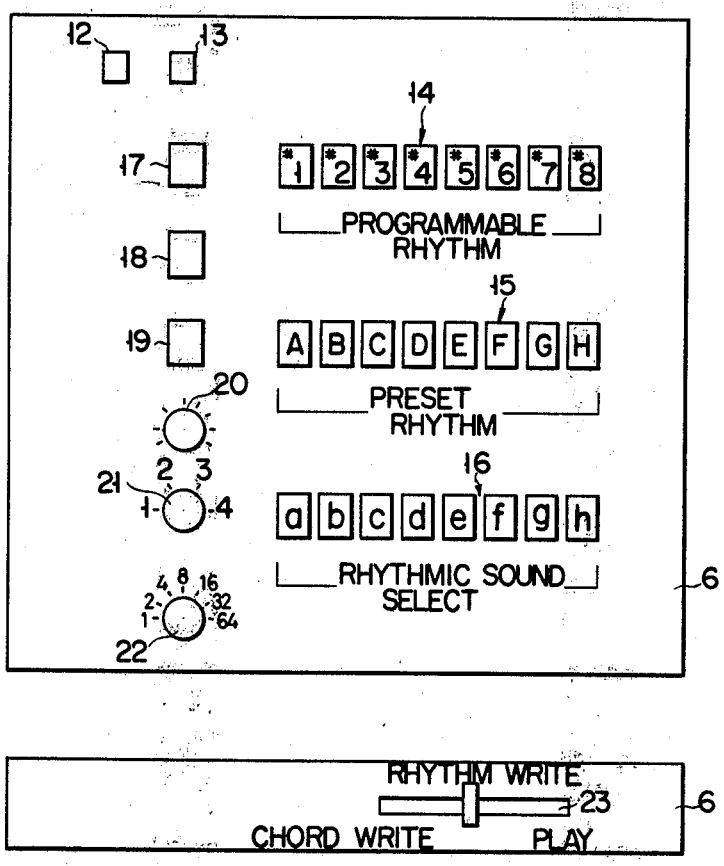
FIG. 2 shows in detail a plan view of a second operation unit of the electric organ in FIG. 1.
Figure 3A:
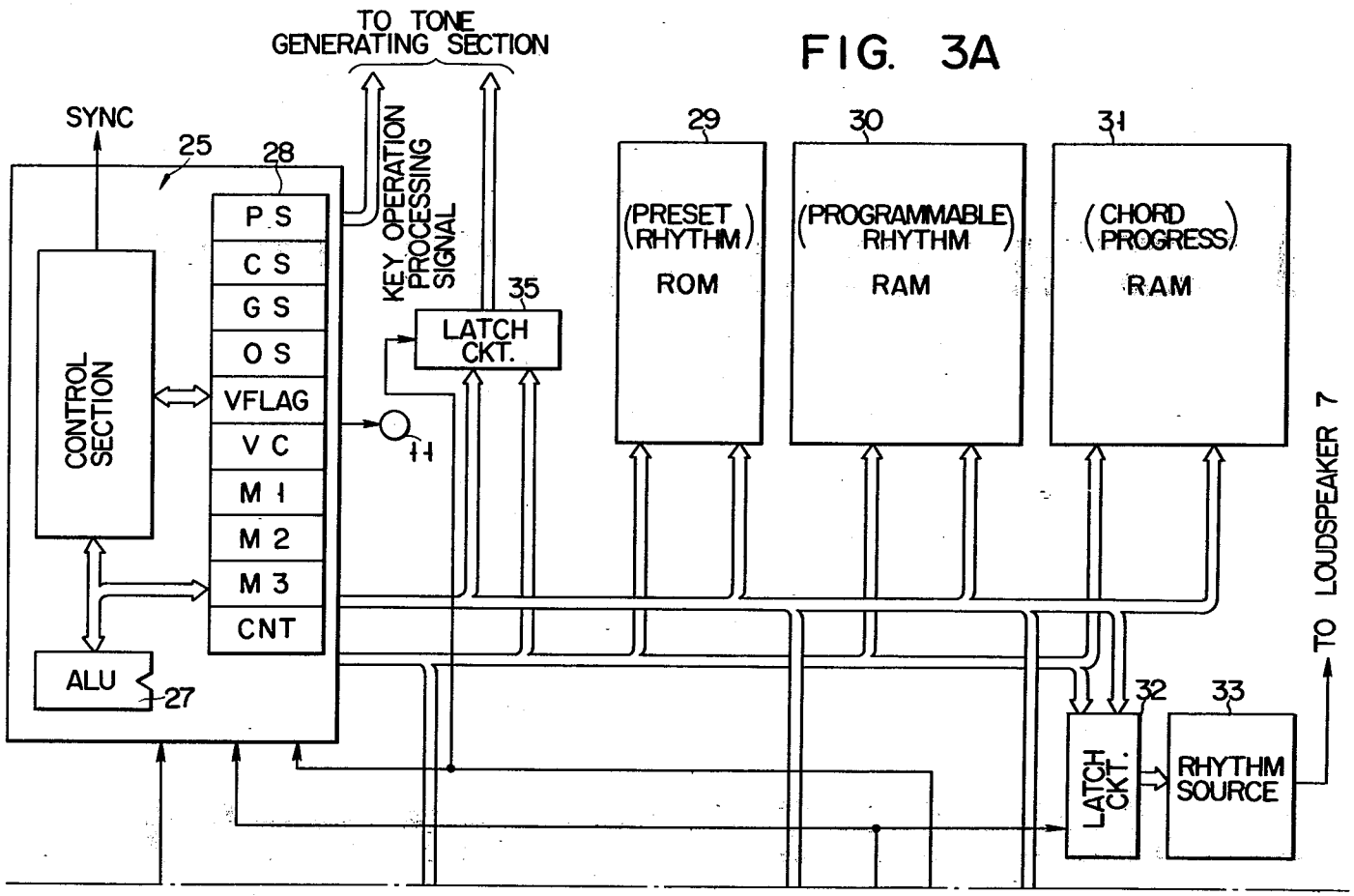
FIGS. 3A and 3B show cooperatively a circuit diagram of the embodiment.
Figure 3B:
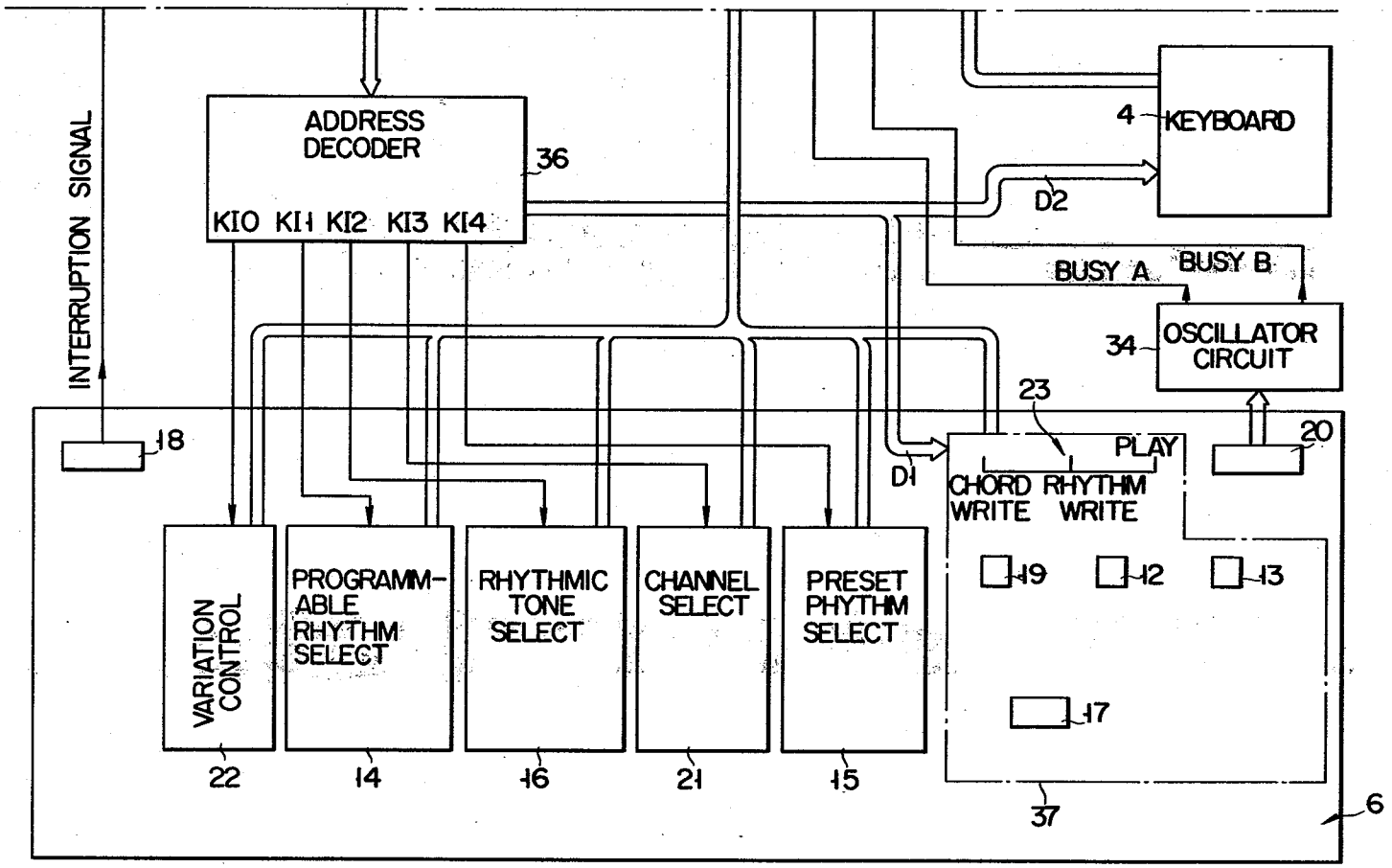

FIG. 1 shows an electronic organ provided with an automatic rhythm accompaniment system which is an embodiment according to the present invention. The electronic organ 1, as shown in the Figure, includes support legs 2 and 2, and a main body 3 supported by those legs 2 and 2. On the main body 3, provided are a keyboard 4, first and second operation units 5 and 6, a loudspeaker 7 and a music stand 8. An electronic circuit shown in FIG. 3A and FIG. 3B is contained in the main body 3. The keyboard 4 has 50 keys of pitches ranging from B1 to C6 for the ordinary performance. The first operation unit 5 contains a power switch 9, a volume switch 10 and the like. The second operation unit 6 contains various switches which will be described referring to FIG. 2. A tempo lamp 11 provided on the music stand 8 lights up for each measure to enable a player to check a tempo of a musical piece or passage.

The construction of the second operation unit 6 will be described referring to FIG. 2. An ad-lib set switch 12 is operated to store in a RAM (random access memory) 31, for storing chord progress data shown in FIG. 3A, a rhythm pattern number for filling in ad-lib rhythm and chord data representing a chord progress state. In the present embodiment, eight kinds of programmable rhythms #1 to #8 are available as the ad-lib rhythms. Rhythm patterns together with the names of rhythm instruments, are stored in a RAM 30 for programmable rhythm storage. The programmable rhythm is a rhythm pattern which may be properly designated and written by a player. An ad-lib set switch 13 is used to store in the RAM 31 the rhythm pattern number and chord data representing the chord progress state as well to use the rhythm pattern stored in a ROM (read only memory) 29 shown in FIG. 3A as the ad-lib rhythm. The present embodiment uses eight kinds of preset rhythms A to H which are stored in the form of rhythm patterns together with names of the rhythm instruments in the ROM 29.

A programmable rhythm selection switch 14 (FIG. 3B) designates one of the programmable rhythms #1 to #8. A preset rhythm selection switch 15 (FIG. 3B) designates one of the preset rhythms A to H. A rhythm instrument selection switch 16 (FIG. 3B) selects one of the rhythm instrument sounds a to h. The rhythm instruments a to h are selected corresponding to various rhythm instruments such as bass-drum, snare-drum, high hat, las maracas, bongoes, symbals, and the like.

A chord set switch 17 is used when the chord data is stored into the RAM 31. In the present embodiment, each chord data is designated by operating performance keys on the keyboard 4. Various chords, such as major, minor, seventh, and diminish, corresponding to tone names such as C, C#, . . . , B are keyed in, each being in the form of six-bit data, for example. A chord selection switch provided separately may be used. A program tempo/variation switch 18 is used, in a rhythm write mode, to set a rhythm pattern corresponding to the rhythm instrument selected in that mode, and is used to fill in a proper variation rhythm into a rhythm pattern regularly performed in a play mode to be described later.

A start/stop switch 19 is used in the play mode or in the rhythm write mode to control rhythm start and rhythm stop, or rhythm write start and rhythm write stop. The start/stop switch 19 is an inverting switch which is set to the start or stop side for each switch operation.

A tempo volume switch 20 changes a tempo in the play mode or the rhythm write mode. In accordance with the setting state of the switch 20, a speed of the rhythm accompaniment changes and a lighting interval of the tempo lamp 11 also changes. A channel selection switch 21 designates one of four channels assigned to the respective switches of the programmable rhythm selection switch 14. The switch 21 designates rhythm instruments up to four kinds for the same programmable selection switch 14 and writes the designated one into the RAM 30.

A variation control switch 22 designates the number of measures, i.e. one measure, two measures or another even number of measures, for filling the variation rhythm pattern in the musical piece being performed when the program tempo/variation switch 18 is operated in the play mode. Specifically, the control switch 22 has seven kinds of switching positions weighted to "1", "2", "8", "16", "32" and "64", as shown in the figure. In accordance with the switching positions, the variation rhythm pattern is filled in the musical piece being performed every measure, every two measures, every four measures, . . . , every 64 measures.

A mode switch 23 designates one of the chord write mode, the rhythm write mode, and the play mode. The chord write mode is for designating the write of the chord data.

A circuit arrangement of a major part of the automatic rhythm accompaniment system will be described referring to FIGS. 3A and 3B. A central processing unit (CPU) 25 is comprised of a control section 26, an arithmetic logic unit (ALU) 27, a register section 28, and other associated sections. The control section 26 stores a control program to control various operations of the electronic organ. The ALU 27 executes various operations on the basis of the input data fed from the control section 26 or the register section 28, enabling the execution of three kinds of modes. The register section 28 contains a PS register, a CS register, a GS register, an OS register, a VFLAG register, a VC register, an M1 register, an M2 register, an M3 register, CNT register, and the like. The PS, CS and GS registers are used respectively for temporarily storing various data representing the number of the ad-lib rhythm, the channel, and the rhythm instrument stored in the programmable rhythm storing RAM 30. The OS register is for temporarily storing the number of the preset rhythm stored in the preset rhythm storing ROM 29. The VFLAG register is a register for storing temporarily a variation flag. In the play mode, when the program tempo/variation switch 18 is turned on, a binary logic level "1" is loaded into the VFLAG register. On the other hand, a level "0" is loaded thereinto upon turning off of the switch 18. The VC register is used as a down counter in the play mode. 7-bit data ("1", "2", . . . , "64") in the decimal system) shown in FIG. 7 is set as an initial value in the VC register in accordance with the set position (switch position) of the variation control switch 22, "1", "2", . . . , "64". The M1 register and the M2 register temporarily store data respectively (expressing one measure by 8 bits) for providing rhythm pattern read out from the RAM 30 or the RAM 29. The M3 register temporarily stores data for providing the rhythm pattern of the ad-lib rhythm read out from the ROM 29 or RAM 30. The M1, M2 and M3 registers have each a memory capacity of four channels. The CNT register is used as a counter in the rhythm write mode. To the CNT register, finally written is the data for providing the rhythm pattern of the ad-lib rhythm, then transferred to the designated memory area of the RAM 30.

The CPU 25 is interconnected with the ROM 29, the RAM 30 and the RAM 31 through a data bus and an address bus as shown. The ROM 29, RAM 30 and RAM 31, when addressed by the CPU 25, allows data to be written into and read out from those memories per se. The rhythm pattern data read out from the ROM 29 or RAM 30 is latched in a latch circuit 32 and then is applied to a rhythm sound source circuit 33. The operation of the latch circuit 32 is controlled by a timing signal BUSYA derived from an oscillating circuit 34. The timing signal BUSYA is produced on the bases of a signal having a period corresponding to a time length of an 8th note ( ). The rhythm sound source 33, when receiving the rhythm pattern data latched in the latch circuit 32, generates corresponding rhythm sound signals (including four kinds of rhythm instrument signals at the maximum), and transfers them to the loudspeaker 7. The chord data read out for each measure from the RAM 31 is latched in the latch circuit 35 and then is transferred to a tone generating section (not shown). The operation of the latch circuit 35 is controlled by the timing signal BUSYB generated by the oscillator 34 at the period with reference to a time length corresponding to one measure length on the basis of the tempo set at that time. The tone generating section forms a chord signal on the basis of the chord data latched in the latch circuit 35 and supplies it to the loudspeaker 7.

The key-in signal outputted from the keyboard 4 is applied to the CPU 25 via the data bus as shown. Upon receipt of the key-in signal, the CPU 25 properly processes the signal received to judge a pitch, a length of tone, volume and the like of the key-in signal, and then transfers the signal processed to the tone generating section to form a corresponding tone.

A data area of the programmable rhythm storage RAM 30 is defined as shown in FIG. 5. The data area of the RAM 30 is divided into 8 subareas in accordance with eight kinds of rhythms. The eight subareas, called PS areas, are numbered with #1 to #8, respectively. Each of the PS area is further divided into four areas, which correspond to four channels. The four areas will be called CS areas. The CS areas are numbered 1 to 4, respectively. Thus, the RAM 30 is addressable in accordance with the contents of the PS areas and CS areas. In this way, the data representing the name of a rhythm instrument and the rhythm pattern data is written into the channel of one rhythm. The data area of the ROM 29 for preset rhythm storage is similarly constructed as the RAM 30.

The construction of the data area of the RAM 31 for chord progress storage is as shown in FIG. 6. The chord area representing a chord progressing state is stored for every measure, for example. In the present embodiment, the number of ad-lib rhythm as well as the chord progress state data are stored in the RAM 31. It is for this reason that the data area of each measure is divided into an ad-lib flag memory area (AFLAG), an ad-lib rhythm number memory area, and a chord memory area. For storing the ad-lib rhythm, logical "1" is stored into the ad-lib flag memory area. For not storing the ad-lib rhythm, logical "0" is loaded into the AFLAG. The number of the rhythm patterns stored in the ROM 29 or the RAM 30 (for example, the contents of the PS area shown in FIG. 5) are loaded into the ad-lib rhythm memory area. The chord data is loaded into the chord memory area.

Figures 4A, 4B:
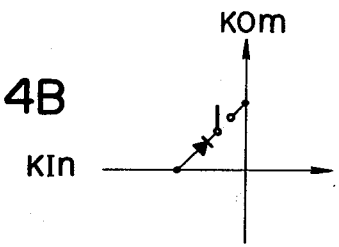
FIG. 4A shows a relation between a row input signal KIn to switches arrayed in a matrix fashion and a column output signal KOm.
FIG. 4B shows a scheme of each of the switches.

The explanation to follow is how to detect the operations of the switches on the second operation unit 6 and of the keys on the keyboard 4. The switches 22, 14, 16, 21 and 15 on the second operation unit 6 are respectively arrayed in a 5×8 matrix. Signals KI0 to KI4 obtained by decoding address data outputted from the CPU 25 by an address decoder 36 are applied as row input signals to the switches 22, 14, 16, 21 and 15, respectively, so that the on or off state of each switch is detected. The on/off detecting signals are transferred as column output signals KO1 to KO8 to the CPU 25 by way of the data bus. FIG. 4A tabulates relations between the row input signals KI0 to KI4 and the column output signals KO1 to KO8 of the switches 22, 14, 21 and 15. For example, when only the row input signal KI0 is outputted with "1", only a set state of the variation control switch 22 is detected. When it is set to "4", for example, the column output signals KO1 to KO7 are outputted as 7-bit data with the contents "0010000" in the order of KO1, KO2, . . . , KO8. The column output signal KO8 at the 8th bit is fixed to "0" and is treated as an ineffective bit. In FIG. 4A, the ineffective bits of the variation control switch 22 are indicated by slanted lines. The ineffective bit of the channel selection switch 21 is also indicated similarly. FIG. 4B shows a relation between the row input signal KIn (n=0 to 4) and the column output signal KOm (m=1 to 8).

Switch group 37, including the switches 12, 13, 17, 19 and 23, is also formed in a given matrix array. The on and off states of the switches are detected by a signal D1 obtained by decoding a given address data outputted from the CPU 25 by the address decoder 36. The result of the detection is transferred to the CPU 25 through the data bus. The performance keys on the keyboard 4 are also formed in a matrix array. A signal D2 outputted from the address decoder 36 after a similar process is used to detect the on/off state of each performance key.

As shown in FIG. 3B, a signal outputted from the tempo volume switch 20 is applied to the oscillator circuit 34 where the timing signals BUSYA and BUSYB are generated. The timing signals BUSYA and BUSYB and the output signal (interrupt signal) from the program tempo/variation switch 18 are all applied to the CPU 25. At the start of each measure, the CPU 25 produces a synchronizing signal SYNC to synchronize the respective circuits.

Figure 8:
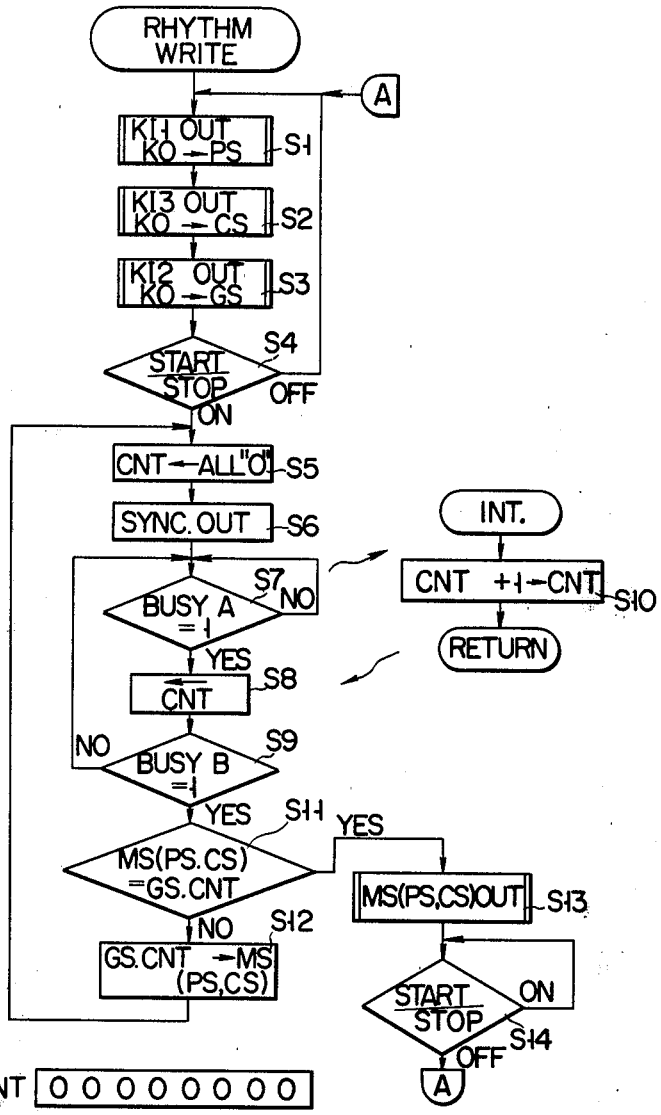
FIG. 8 is a flow chart for explaining the operation of the embodiment in a rhythm write mode.
Figure 9:
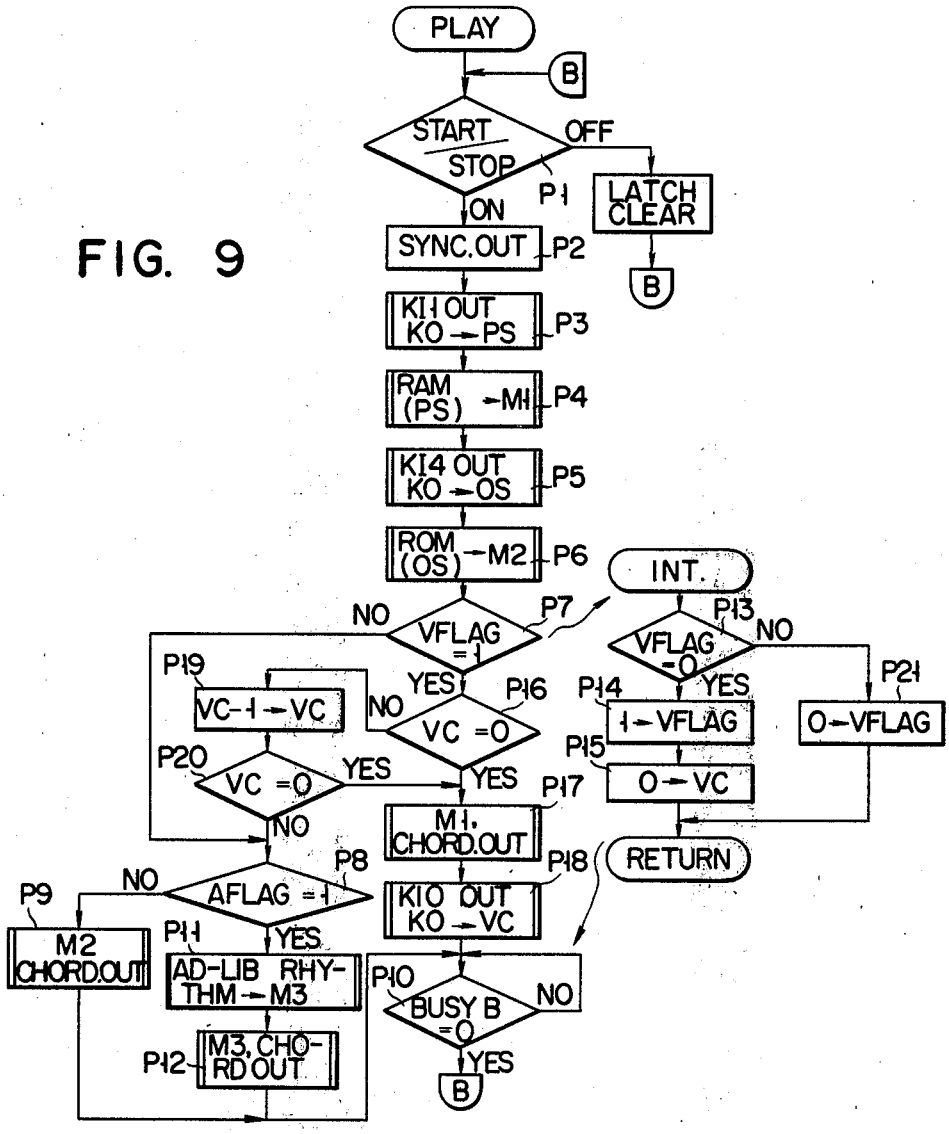
FIG. 9 is a flow chart for explaining the main operation in a play mode.

The operations of the rhythm write mode and the play mode will be described referring to FIGS. 8 to 10. The detail of the write operation of the ad-lib rhythm number and the chord data into the chord progress storing RAM 31 will be omitted. In the chord write mode, the mode switch 23 is first turned to the chord write mode position, and then start/stop switch 19 is turned on. Following the step, a given performance key on the keyboard 4, the chord set switch 17 and the ad-lib set switches 12 and 13 are operated to successively write the chord data and the ad-lib rhythm number for each measure. After the write operation is completed, the start/stop switch 19 is turned off.

The rhythm write mode operation will first be given referring to FIGS. 5, 8, 10A to 10E. In this case, the mode switch 23 is set to the rhythm write position. The programmable rhythm selection switch 14, the channel selection switch 21, and the rhythm instrument selection switch 16 are previously set to the desired positions, respectively. After the switch 14 is set to "1", the rhythm number to be written into the RAM 30 to correspond to the "1". The switch 21 is switched to "1" to designate the first channel. Additionally, the switch 16 is switched to "a" to designate the rhythm instrument to the bass drum.

When the switches 14, 21 and 16 are set to the above-mentioned states, following the start of the rhythm write mode, the process of S1 to S4 is repeatedly continued until the start/stop switch 19 is turned on. In the step S1, the address data to apply the row input signal KI1 with "1" to the switch 14 is outputted from the CPU 25 to address bus and to the address decoder 36. The on/off state of the switch 14 is detected by the row input signal KI1 of "1" state. Since the switch 14 has been set to "1", the 8-bit data "10000000" are outputted as column signals KO1 to KO8 and transferred to the CPU 25 through the data bus. The CPU 25 processes the data "10000000" to write the data "1" (in decimal numeral) representing the programmable rhythm number "1" into the PS register. In the step S2, the row input signal KI3 of "1" is similarly outputted from the address decoder 36, so that the on/off state of the switch 21 is detected. Since the switch 21 has been set to "1", the 4-bit data "1000" are outputted as the column output signals KO1 to KO4 toward the CPU 25. The CPU 25 processes the data "1000" to write data "1" (decimal numeral: channel number) representing the first channel into CS register. At the step S3, the row input signal KI2 of "1" is outputted and the on/off state of the switch 16 is similarly detected. At present, the switch 16 is set to "a" and hence the 8-bit data "10000000" are outputted as the column output signals KO1 to KO8 toward the CPU 25. The CPU 25 then processes the data to load the data "1" (decimal numeral) representing the name of the rhythm instrument of the bass drum into the GS register. In the next step, it is judged whether the start/stop switch 19 is turned on or not. If it is not turned on, the sequence of the steps S1 to S3 is repeated. In this case, if the set state of the switches 14, 21 and 16 is left as it is until the start/stop switch 19 is turned on, the data in the respective registers PS, CS and GS remain unchanged.

Then, when the start/stop switch 19 is turned on, the on-state is detected by the signal D1 periodically outputted and the steps S5 and S6 are executed. In the step S5, the CNT register is first cleared to have the contents "00000000", as shown in FIG. 10A. In the same step S5, the synchronizing signal SYNC is outputted from the CPU 25, so that the respective circuits are synchronized and the tempo lamp 11 is lit to allow the start of the first measure to be visually be checked. As a result, the oscillator circuit 34 produces the timing signals BUSYA and BUSYB at the time interval according to the set tempo of the tempo volume switch 20. Accordingly, the tempo lamp 11 indicates the tempo at the period in accordance with the timing signal BUSYB.

Assume now that the rhythm inputted of the ad-lib rhythm is enabled to be inputted in the form of an 8th note every other beat. Following the step S6, the steps S7 to S9 are executed each one time for every beat, i.e. at the time interval for the timing signal BUSYA outputting. When the program tempo/variation switch 18 is turned on during the course of the execution of the step S7, an interrupt process S10 is executed. The step S7 judges if the timing signal BUSYA is outputted or if one beat is elapsed or not. If one beat is elapsed, the execution of the step S8 starts, so that the contents of the CNT register is shifted to the left by one bit. Then, in the step S9, it is judged if the timing signal BUSYB is outputted or not, that is, if one measure is elapsed or not. In the step S10, the CNT register is incremented by one (+1) only when the switch 18 is turned on.

As described above, since the rhythm is inputted every other beat in this case, the switch 18 is turned on simultaneously with the lighting of the tempo lamp 11 after the start/stop switch 19 is turned on, and the interrupt signal is applied to the CPU 25. For this reason, the interrupt process S10 is executed during the course of the execution of the step S7 which is at the first beat following the start, so that the contents of the CNT register is incremented by one (+1) to have "00000001", as shown in FIG. 10B. Then, after one beat, the step S8 is executed, so that the contents of the CNT register is shifted to the left by one bit, to be "00000010", as shown in FIG. 10C, in preparation for the interrupt process S10 of the second beat. The program execution returns to the step S7 through the step S9. At the second beat, the switch 18 is not turned on, with the result that the steps S7 to S9 are executed, except the interrupt step S10. Therefore, after the process of the second beat is finished, the contents of the CNT register is "00000100". Then, the third beat process starts to turn on the switch 18. As a result, the interrupt process S10 is executed to increment the CNT register by 1, so that the contents of the register is "00000101" as shown in FIG. 10D. The step S8 further changes the contents of the CNT register to be "00001010" in preparation for the process of the fourth beat.

The on-operation of the switch 18, the sequential process of the steps S7 to S9 and S10 are performed for the succeeding fourth to eighth beats. Through the sequential process, the first measure is elapsed and when the timing signal BUSYB is outputted, the step S11 is initiated. As a result of the operation of the first measure, the rhythm pattern data of the rhythm inputted every other beat has been stored in the CNT register in the form of "10101010", as shown in FIG. 10E. The RAM 30 has an MS register which is addressed by the contents of the PS and CS registers. The step S11 judges if the contents of the MS register are coincident with the contents of the GS register and the CNT register. At this time, the contents of the MS register is not coincident with the contents of the GS and the CNT registers, as a matter of course. Accordingly, the step S12 is executed, and the contents of the GS and CNT registers are transferred to the MS register of the RAM 30. Accordingly, in this case, the contents of the GS and CNT registers are loaded into the areas of PS=1 and CS=1. As a result, the data "1" (decimal numeral) of the PS register and the data "10101010" (binary numeral) of the CS register is loaded thereinto. Then, the CPU process returns to the step S5 where the CNT register is cleared. At the step S6, the synchronizing signal SYNC is produced to light the tempo lamp 11 to indicate the start of the second measure. In the present embodiment, exactly the same operation as that of the first measure is executed as a confirmation operation. Accordingly, the operation to turn on the switch 18 for every other beat is restarted, and the steps S7 to S9 and the step S10 are similarly executed. In this way, the confirmation operation is completed and the timing signal BUSYB is generated. At this time, the step S11 in the second time is executed. In this case, when the confirmation operation is performed in exactly the same manner as that of the first measure, it is detected that the contents of the MS register is coincident with those of the GS and CNT registers, since the contents of the GS and CNT registers were stored in the MS register of the RAM 30 in the previous process of the first measure. Accordingly, the process of the step S13 starts and the data is read out from the MS register and is latched in the latch circuit 32. As a result, the rhythm sound source 33 produces a signal of the rhythm pattern to drive the loudspeaker 7. In this way, the ad-lib rhythm inputted may be aurally confirmed by ear. After the execution of the step S13, the CPU 25 is in a stand-by state until the start/stop switch 19 is turned off. When the start/stop switch 19 is turned off, the procedural operations are completed. In preparation for the following rhythm input, the steps S1 to S3 are executed, and when the start/stop switch 19 is turned on, the next programmable rhythm may be inputted. Through the above-mentioned operations, eight kinds of rhythms may be set in the RAM 30 with four kinds of rhythm instruments for each rhythm.

The play mode operation will be described referring to FIG. 6 and FIG. 9. In the play mode, while a melody is performed by keying the performance keys on the keyboard 4, the automatic rhythm accompaniment and ad-lib rhythm accompaniment may be performed in accordance with the data read out from the chord progress storing RAM 31. Further, during the automatic rhythm accompaniment, when the program tempo/variation switch 18 is manually operated, the rhythm pattern is directly read out from the ROM 29 or ROM 30, in place of the rhythm accompaniment, so that the automatic rhythm performance may be executed in accordance with the variation rhythm. In the play mode operation to be given below, the operation of the melody performance by the electronic organ will be omitted.

Firstly, the mode switch 23 is set to the play mode position. In a step P1, the start/stop switch 19 is turned on for starting the automatic rhythm accompaniment. In the next step P2, the CPU 25 produces a synchronizing signal SYNC to light the tempo lamp 11 which in turn flashes at the tempo according to the set state of the tempo volume switch 20, and the timing signals BUSYA and BUSYB are produced from the oscillating circuit 34. As a result of the processes of the steps P3 and P4, the row input signal KI1 is produced to detect the on/off state of the switch 14. After the result of the detection is inputted to the PS register, the contents of the register of the RAM 30 addressed on the basis of the data are transferred to the register. As a result, the variation rhythm data is loaded into the M1 register. Then, the step P5 and P6 are executed to produce the row input signal KI4 and to detect the on/off state of the switch 15. After the result of the detection is inputted into the OS register, the ROM 29 is addressed on the basis of the data and the corresponding data are transferred into the M2 register. As a result, the data read out from the ROM 29 are loaded into the M2 register to perform the ordinary rhythm performance.

Following the step P6, a step P7 is executed. In the step P7, it is judged that the content of the VFLAG register is "1" or not, that is, if the switch 18 is turned on and the variation rhythm is requested or not. Since the ordinary rhythm accompaniment is performed, a step P8 is executed following the step P7. The step P8 judges whether the content of the AFLAG read out from the RAM 31 is "1" or not, that is, whether the rhythm performance of the ad-lib rhythm by the RAM 31 is designated or not. In this case, the content of the AFLAG is "0" and accordingly the rhythm performance by the ad-lib rhythm is not designated. Therefore, a step P9 is performed to execute the ordinary rhythm accompaniment, so that the rhythm pattern data in the M2 register and the chord data read out from the RAM 31 is applied to the latch circuits 32 and 35, respectively, and then to the rhythm sound source 33 or the tone generating section. As a result, the rhythm by the rhythm pattern (read out from ROM 29) for the ordinary performance designated by the preset rhythm selection switch 15 and the chord designated are used for the automatic accompaniment. In a step P10 following the step P9, the above automatic accompaniment is performed for one measure. During this automatic accompaniment, the contents of the latch circuit 32 is sequentially changed in accordance with the timing signal BUSYA to produce the rhythm sound.

When the step P8 detects that the AFLAG is "1", a request for the rhythm performance by the ad-lib rhythm, together with the chord progress data, is loaded into the RAM 31. Accordingly, the steps P11 and P12 are executed, so that the ad-lib rhythm data designated in the ROM 20 or RAM 30 based on the ad-lib rhythm number read out from the RAM 31 is transferred to the M3 register. Subsequently, the data is applied to the latch circuit 32. The chord data read out from the RAM 31 at this time is transferred to the latch circuit 35. As a result, when the ad-lib rhythm performance as well as the chord progress in the RAM 31 is designated, the ad-lib rhythm designated is read out from the ROM 29 or RAM 30 and the ad-lib rhythm accompaniment is performed together with the chord data at that time.

As described above, the steps P7 to P10 are for the rhythm accompaniment process for the ordinary performance. At the step P10, the rhythm accompaniment of one measure is completed. Upon the completion of the rhythm accompaniment, the step P1 is again reached and the execution of the steps P1 to P6 makes the CPU ready for the rhythm accompaniment of the next measure. The ad-lib rhythm accompaniment designated by the RAM 31 is processed through the sequential process of the steps P7, P8, P11, P12 and P10. When the ad-lib rhythm accompaniment of one measure is completed at the step P10, the CPU returns to the step P1 and prepares for the rhythm accompaniment of the next measure through the process of the steps P1 to P6.

During the automatic rhythm accompaniment, when a player turns on the switch 18 and designates the variation rhythm performance, the interrupt of the steps P13, P14 and P15 is executed. Since the present performance is the ordinary rhythm accompaniment, the content of the VFLAG register is "0". For this, a flag "1" representing the ON state of the switch 18 is loaded into the VFLAG register, and at the same time the content of the VC register is cleared. Then, the CPU returns to the original program flow and the automatic rhythm accompaniment is completed. When the step P7 is reached through the steps P1 to P6, it is detected that the content of the VFLAG is "1" as a result of the interrupt process. Subsequently, the step P17 is executed following the step P16. In the step P17, the content of the M1 register is outputted and the rhythm pattern data of the programmable rhythm is latched in the latch circuit 32. The chord data of this measure read out from the RAM 31 is latched in the latch circuit 35 and is outputted. Further, the step P18 is executed to produce the row input signal KI0 and to detect the set state of the variation control switch 22. The set state detected is loaded into the VC register. In other words, data indicating at what measure the variation rhythm (programmable rhythm) is filled in the ordinary performance rhythm, that is, the data to indicate the way of the variation, for example, "4" ("0000100" in binary; see FIG. 7), is loaded into the VC register. The data "4" indicate that the ad-lib rhythm is applied once for four measures. Then, when the step P10 detects that the rhythm performance by the ad-lib rhythm is executed for one measure, the CPU returns to the step P1 and enters the process of the next measure. Through the steps P1 to P6, the step P16 is reached after the execution of the step P7. At this stage, the data in the VC register is not "0". For this, the step P19 is executed to decrement the contents of the VC register by one. Accordingly, the contents of the VC register becomes "3". Then, the step P8 is reached after the step P20. As described above, the step P8 judges if the ad-lib performance by the RAM 31 is designated or not. If the designation of the ad-lib performance is not made, the CPU advances to the step P9. In other words, if the switch 15 is not designated, it further advances to the step P9. As a result, the rhythm for the ordinary performance designated by the switch 15, together with the chord, is performed. On the other hand, if the ad-lib rhythm performance is designated, the rhythm based on the ad-lib rhythm read out from the ROM 29 or RAM 31 in accordance with the designation of the data read out from the RAM 31, is performed together with the chord. In this way, the rhythm performance by the step P9 or by the steps P11 and P12 is executed for one measure. Following the execution of the rhythm performance, the CPU returns to the step P1 through the step P10. Thus, the process of the steps P1 to P7, P16, P19, P20, P8, P9, P10 or the steps P1 to P7, P16, P19, P20, P8, P11, P12 and P10, is further executed two times until the content of the VC register becomes "0", so that the rhythm performance not by the variation rhythm is further continued for two measures. In the next measure, the variation rhythm accompaniment by the variation rhythm is performed again as in the previous manner. Then, in the following three measures, the ordinary rhythm accompaniment or the ad-lib accompaniment is performed. In this manner, when the switch 22 is set to "4", the variation rhythm performance is executed once for four measures. When the rhythm performance that the variation rhythm enters in a given measure is to be stopped and when it is desired to return it to the ordinary performance, the switch 18 is operated. As a result, the interrupt process is executed and the step P21 is executed after the step P13, so that the content of the VFLAG register is cleared. Therefore, the ordinary performance is made again in the following measures.

To stop the rhythm accompaniment thus made, the start/stop switch 19 is turned off. The off state of the switch is detected in the step P1 and the step P22 is executed and the latch circuits 32 and 35 are both cleared, to cease the rhythm sound and the accompaniment sound, and the automatic rhythm accompaniment is stopped.

In the above-mentioned embodiment, the ad-lib rhythm performance may be made on the basis of the rhythm pattern data preset in the ROM 29 and the rhythm pattern data properly written into the RAM 30 by the operator as well. The present invention is further applicable for the automatic rhythm accompaniment system provided with only the ROM 29 or RAM 30.

Although the period of the ad-lib performance is one measure in the above-mentioned embodiment, it may be changed to two measures or more.

Further, in the above-mentioned embodiment the chord progress data and the control data which execute the ad-lib rhythm performance are written into the RAM 31 in the format as shown in FIG. 6. The format is not so limited. The above-mentioned embodiment is an example in which the present invention is applied to the electronic organ. However, the automatic rhythm accompaniment system of the present invention may be made as an individual unit. The means to write the chord progress data may be an input device having a plurality of push-buttons or other suitable input devices. When the system of the present invention is used as an individual unit, the loudspeaker or the tone generating circuit may be that of the electronic organ associated therewith. The embodiments may be changed or modified without departing from the scope of the present invention.

What is claimed is:

1. An automatic rhythm accompaniment system comprising:

first memory means for storing a plurality of rhythm pattern data items;

selecting means for selecting one of the rhythm pattern data items stored in said first memory means;

rhythm sound generating means coupled with said first memory means for generating rhythm sounds in accordance with a rhythm pattern data item selected by said selecting means and read out from said first memory means;

second memory means for storing chord progress data and control data, said control data being stored in said second memory means in accordance with said chord progress data;

accompaniment sound generating means coupled with said second memory means for generating accompaniment sounds according to said chord progress data; and control means coupled to said first and second memory means and being responsive to stored control data derived from said second memory means for reading out from said first memory means a rhythm pattern data item other than said rhythm data item selected by said selecting means, and for supplying said other rhythm pattern data item to said rhythm sound generating means to generate rhythm sounds according to said other rhythm pattern data item.

2. The system of claim 1, wherein said first memory means includes:

read only memory means for fixedly storing a plurality of rhythm pattern data items;

read/write memory means for storing one or more rhythm pattern data items; and rhythm pattern setting means coupled with said read/write memory means for setting said rhythm pattern data items into said read/write memory means.

3. The system of claim 2, wherein said read only memory means comprises a ROM; and said read/write memory means comprises a RAM.

4. An electronic organ comprising:

a plurality of performance keys selectively operable to designate notes of a musical scale;

tone producing means coupled to said performance keys for producing tones corresponding to the respective notes associated with the operated performance keys;

first memory means for storing a plurality of rhythm pattern data items;

selecting means for selecting one of the rhythm pattern data items stored in said first memory means;

rhythm sound generating means coupled with said first memory means for generating rhythm sounds in accordance with a rhythm pattern data item selected by said selecting means and read out from said first memory means;

second memory means for storing chord progress data and control data, said control data being stored in said second memory means in accordance with said chord progress data;

an accompaniment sound generating means coupled with said second among means for generating accompaniment sounds according to said chord progress data; and a control means coupled to said first and second memory means and being responsive to stored control data derived from said second memory means for reading out from said first memory means a rhythm pattern data item other than said rhythm pattern data item selected by said selecting means, and for supplying said other rhythm pattern data item to said rhythm sound generating means to generate rhythm sounds according to said other rhythm pattern data item.

5. The electronic organ of claim 4, wherein said first memory means includes:

read only memory means for fixedly storing a plurality of rhythm pattern data items;

rear/write memory means for storing one or more rhythm pattern data items; and rhythm pattern setting means coupled with said read/write memory means for setting said rhythm pattern data items into said read/write memory means.

6. The electronic organ of claim 5, wherein said read only memory means comprises a ROM; and said read/write memory means comprises a RAM.

* * * * *

UNITED STATES PATENT AND TRADEMARK OFFICE

CERTIFICATE OF CORRECTION

PATENT NO. : 4,344,345

DATED : August 17, 1982

INVENTOR(S) : Shigenori SANO

It is certified that error appears in the above—identified patent and that said Letters Patent is hereby corrected as shown below:

Column 12, line 38 (Claim 4), change "said second among means" to --said second memory means--.

Signed and Sealed this

*Eighth* Day of *March 1983*

[SEAL]

*Attest:*

GERALD J. MOSSINGHOFF

*Attesting Officer*

*Commissioner of Patents and Trademarks*